United States Patent [19]

Horton et al.

[11] 3,934,528

[45] Jan. 27, 1976

[54] MEANS AND METHODS FOR ANCHORING AN OFFSHORE TENSION LEG PLATFORM

[75] Inventors: Edward E. Horton, Portuguese Bend; John H. Brewer, Irvine; William H. Silcox, Newport Beach; T. A. Hudson, Balboa Island, all of Calif.

[73] Assignees: Deep Oil Technology, Inc., Long Beach; Chevron Oil Field Research Co., La Habra, both of Calif.

[22] Filed: June 3, 1974

[21] Appl. No.: 475,800

[52] U.S. Cl. ..... 114/.5 D; 61/46.5; 114/43.5 R

[51] Int. Cl.[2] ..... B63B 35/44

[58] Field of Search ... 9/8 P; 114/.5 D, 230, 43.5 R; 61/46.5

[56] References Cited

UNITED STATES PATENTS

| | | | |
|---|---|---|---|
| 2,399,656 | 5/1946 | Armstrong | 114/.5 D |
| 3,559,410 | 2/1971 | Blenkarn et al. | 61/46.5 |
| 3,641,776 | 2/1972 | Diamond | 61/46.5 X |

*Primary Examiner*—George E. A. Halvosa
*Attorney, Agent, or Firm*—Edward F. Jaros

[57] ABSTRACT

An apparatus and method for anchoring an offshore tension leg platform which includes a platform supported above an ocean surface by buoyant supports comprising at least three vertical buoyant support members. Each vertical support member includes a central axial conductor tube for passage of drill pipe adapted to be connected to anchor members carried at the bottom of the vertical support member, the drill pipe providing a for lowering the anchor member, for drilling beneath the anchor member to pin the anchor member in the ocean bottom, and for transfer of ballast from the vertical support member to the anchor member. Each vertical support member includes longitudinally extending anchor line casings spaced from the axial tube to provide passageways for anchor tension lines connected to the anchor and adapted to be tensioned at the upper end of the vertical support member or at the platform. A method of anchoring a tension leg platform wherein anchor members are substantially empty when lowered and are filled with ballast material at or near the sea floor. A method which includes advantages in mobility, installation, and anchoring of a tension leg platform under varying weather and sea conditions.

20 Claims, 21 Drawing Figures

Fig. 1.
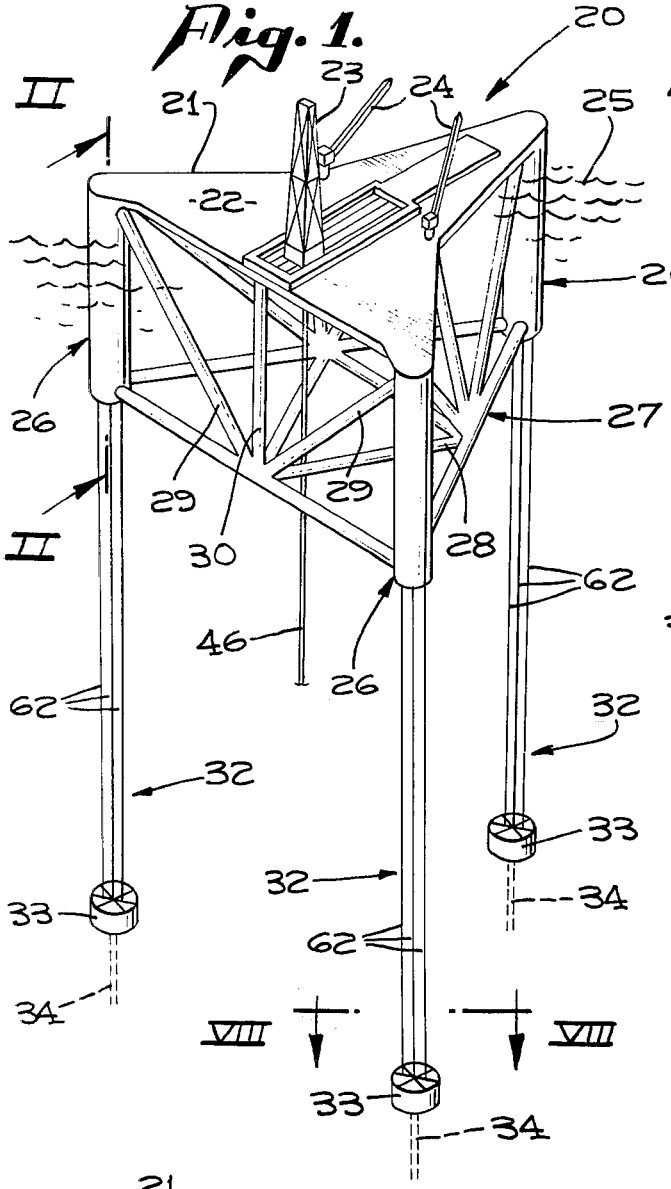
Fig. 6.
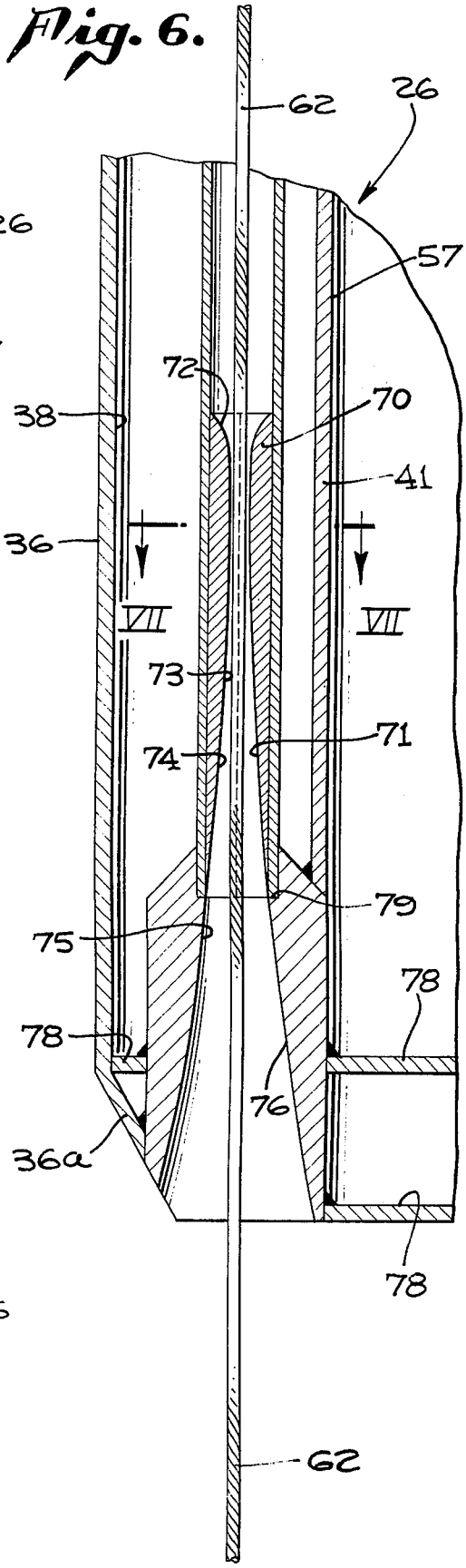
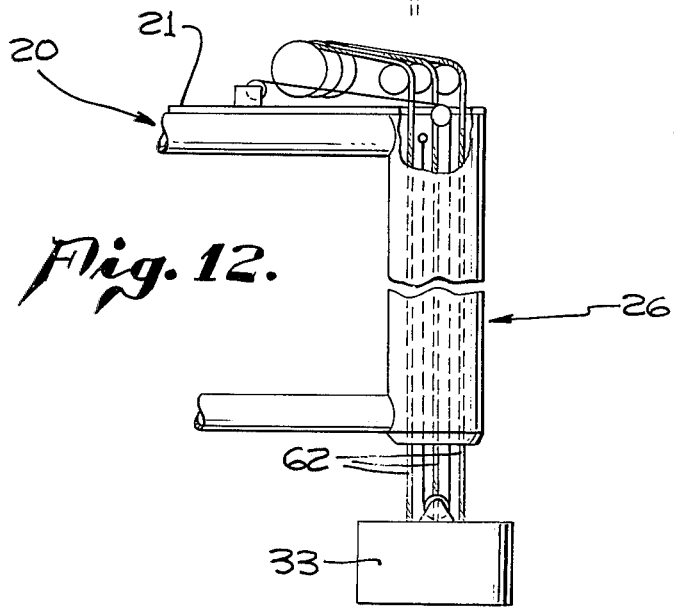
Fig. 12.

Fig. 5.
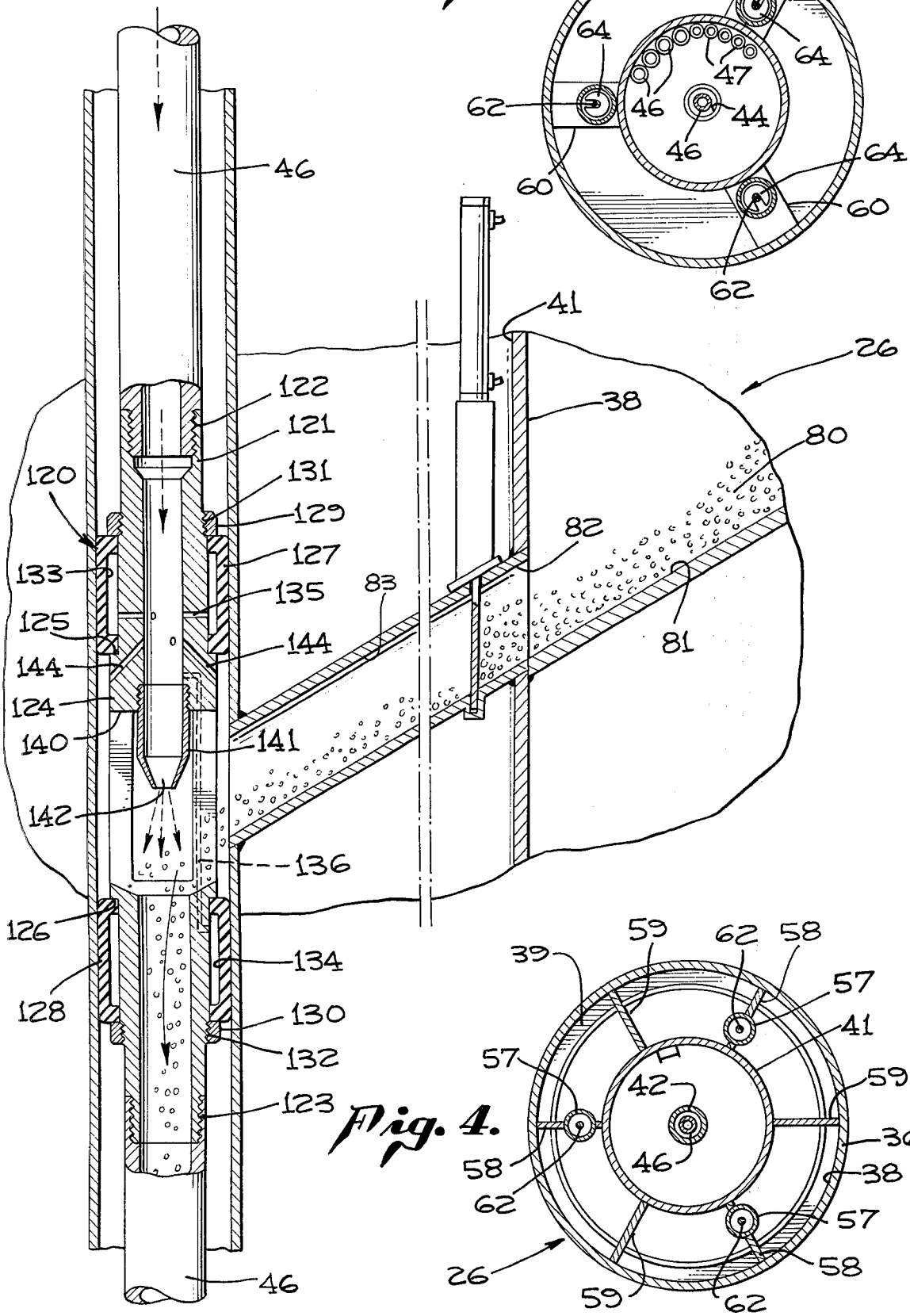
Fig. 3.
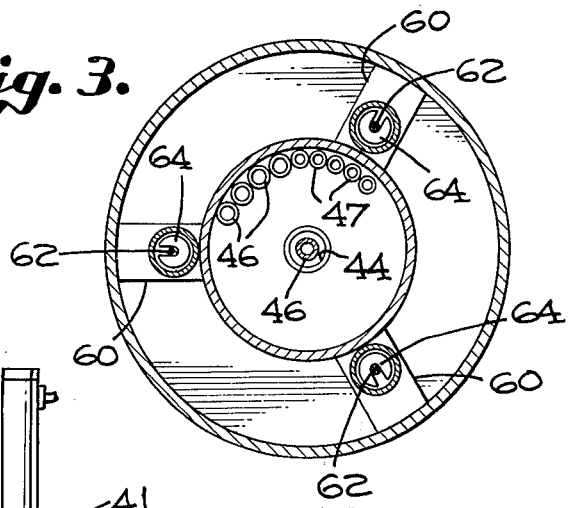
Fig. 4.

Fig. 8.
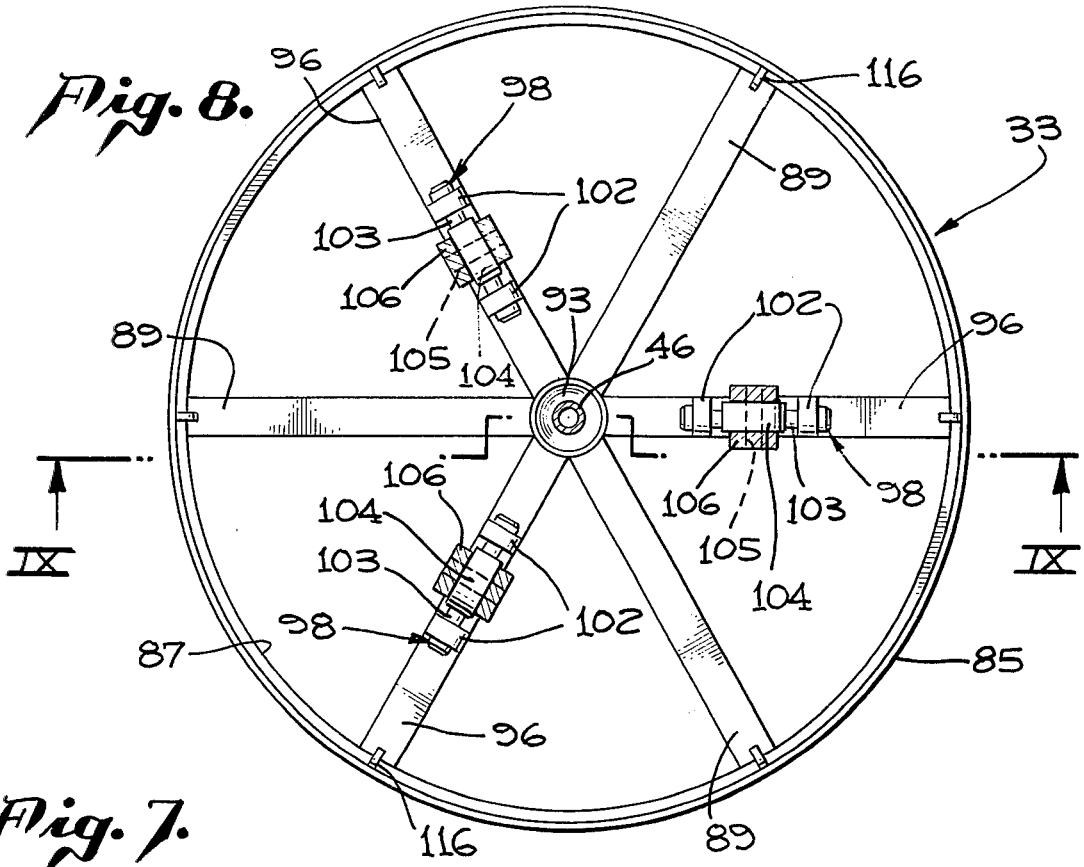
Fig. 7.
Fig. 9.
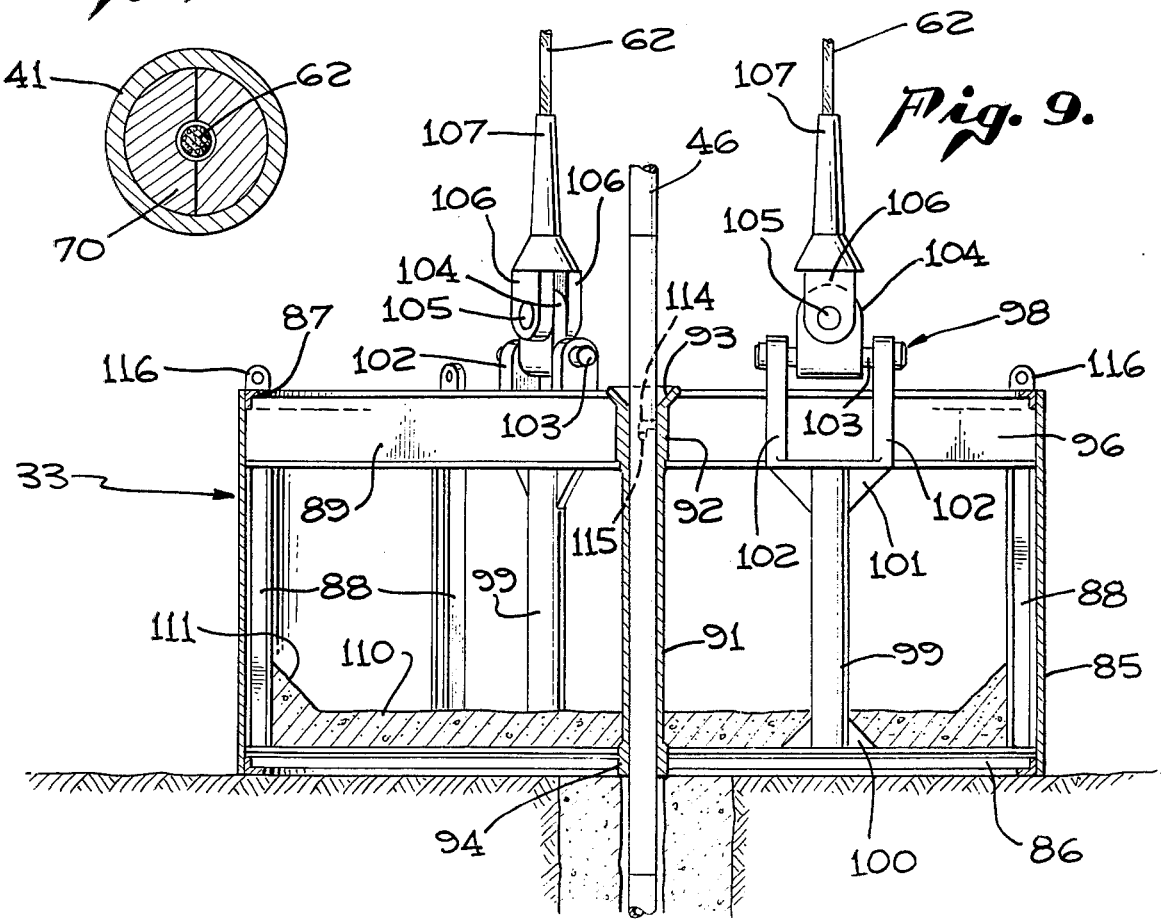

| LOAD CATEGORIES | LOAD AND BALLAST CONDITIONS | | | |
|---|---|---|---|---|
| | CONDITION | WEIGHT, KIPS | CONDITION | WEIGHT, KIPS |
| HULL AND MACHINERY | — | 18,000 | — | 18,000 |
| VARIABLE LOADS | LIGHT | 600 | LIGHT | 600 |
| BALLAST TANKS | LIGHT | — | PARTIAL | 2,600 |
| ANCHOR BALLAST TANKS | FULL - DRY | 9,500 | FULL - FLOODED | 10,600 |
| ANCHOR SHELL | EMPTY | 900 | EMPTY | 900 |
| TOTAL WEIGHT | | 29,000 | | 32,700 |
| DISPLACEMENT | | 29,000 | | 32,700 |
| DRAFT | | 122 FT | | 142 FT |
| CABLE TENSION | | | | |
| ANCHOR FORCE ON SEA FLOOR | | 0 | | 0 |

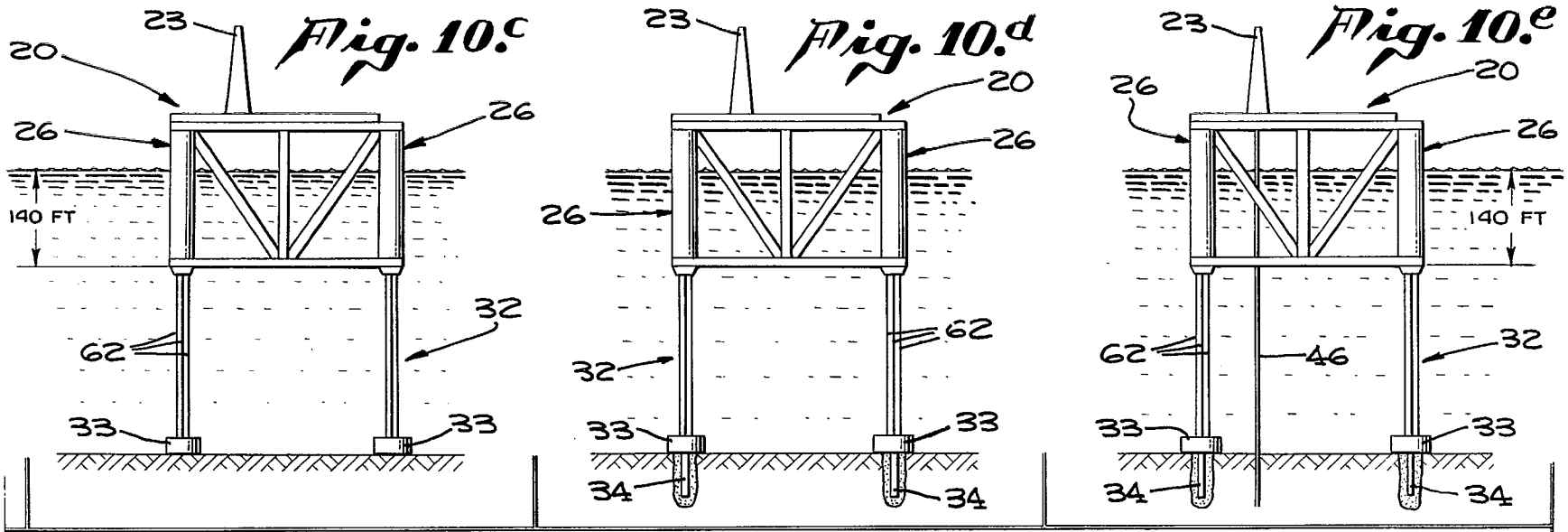
LOAD AND BALLAST CONDITIONS
| CONDITION | WEIGHT, KIPS | CONDITION | WEIGHT, KIPS | CONDITION | WEIGHT, KIPS |
|---|---|---|---|---|---|
| — | 18,000 | — | 18,000 | — | 18,000 |
| LIGHT | 600 | LIGHT | 600 | MAX. | 6,300 |
| PARTIAL | 2,600 | PARTIAL | 5,340 | PARTIAL | 2,740 |
| FULL- FLOODED | 10,600 | FLOODED | 3,100 | EMPTY | — |
| ON BOTTOM | — | ON BOTTOM | — | ON BOTTOM | 0 |
| | 31,800 | | 27,040 | | 27,040 |
| | 32,340 | | 32,340 | | 32,340 |
| | 140 FT | | 140 FT | | 140 FT |
| | 540 | | 5,300 | | 5,300 |
| | 360 | | 3,100 | | 3,100 |

Fig. 11.a
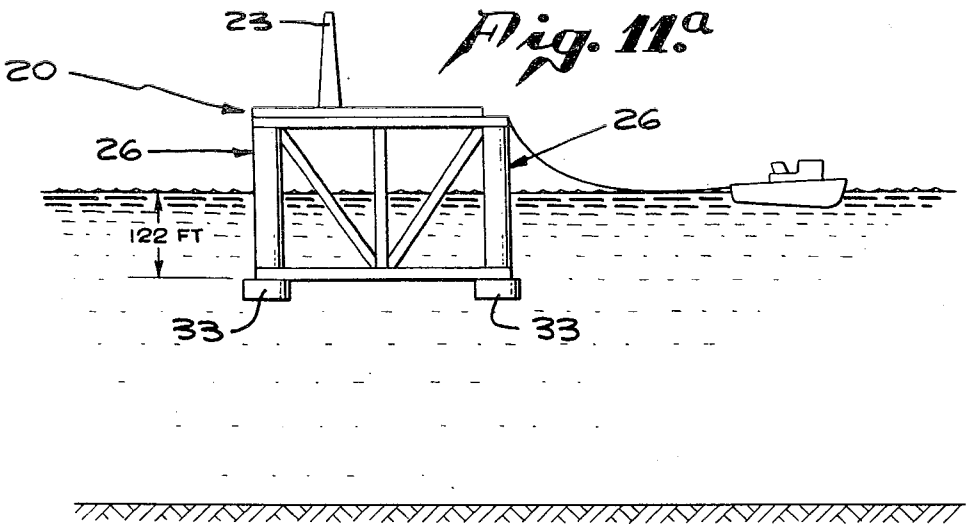
Fig. 11.b
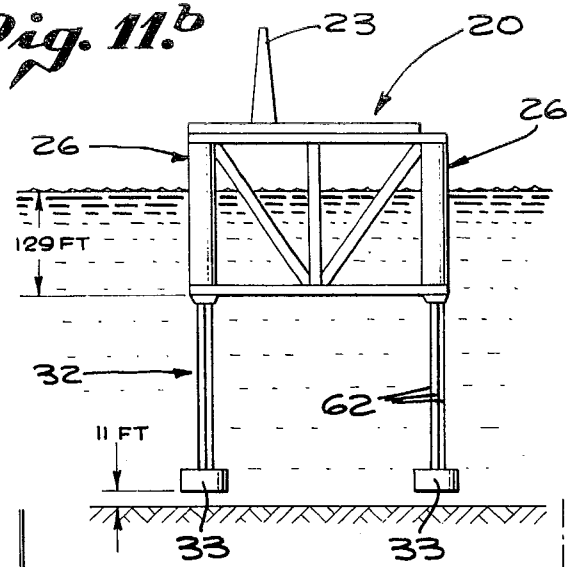
| LOAD CATEGORIES | LOAD AND BALLAST CONDITIONS | | | |
|---|---|---|---|---|
| | CONDITION | WEIGHT, KIPS | CONDITION | WEIGHT, KIPS |
| HULL AND MACHINERY | — | 18,000 | — | 18,000 |
| VARIABLE LOAD | LIGHT | 600 | LIGHT | 600 |
| BALLAST TANKS | LIGHT | — | LIGHT | — |
| ANCHOR BALLAST TANKS | FULL-DRY | 9,500 | FULL-FLOODED | 3,240 |
| ANCHOR SHELL | EMPTY | 900 | EMPTY | 8,400 |
| TOTAL WEIGHT | | 29,000 | | 30,240 |
| DISPLACEMENT | | 29,000 | | 30,240 |
| DRAFT | | 122 FT | | 129 FT |
| CABLE TENSION | | | | |
| ANCHOR FORCE ON SEA FLOOR | | 0 | | 0 |

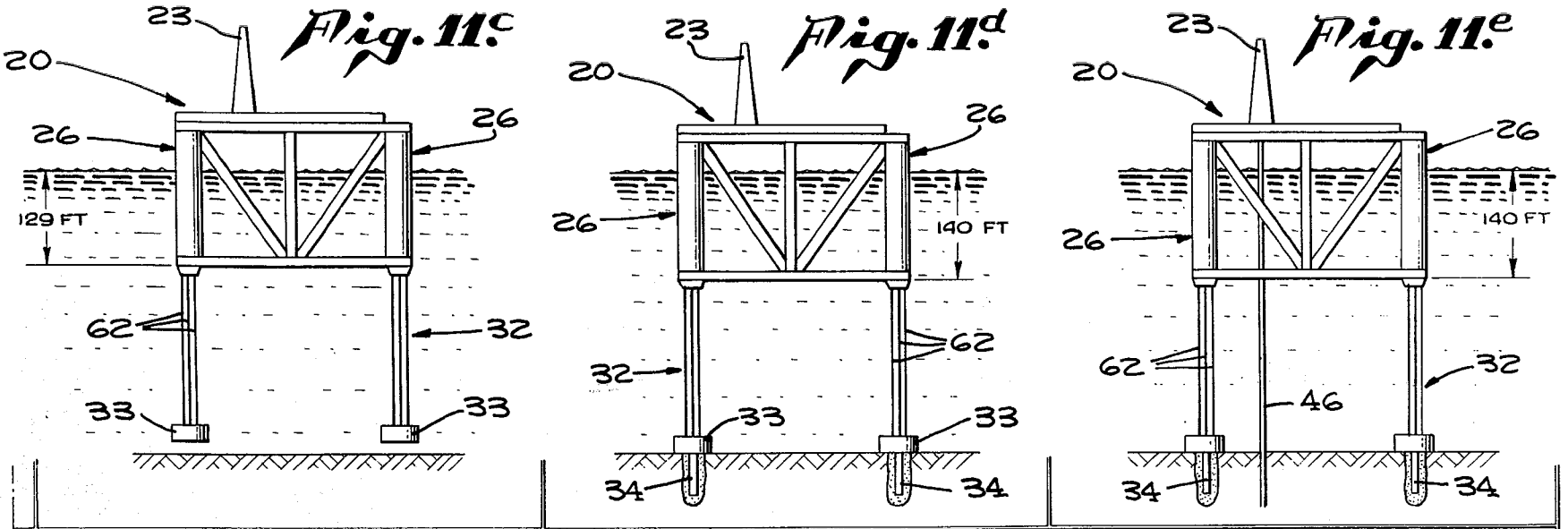
LOAD AND BALLAST CONDITIONS
| CONDITION | WEIGHT, KIPS | CONDITION | WEIGHT, KIPS | CONDITION | WEIGHT, KIPS |
|---|---|---|---|---|---|
| — | 18,000 | — | 18,000 | — | 18,000 |
| LIGHT | 600 | LIGHT | 600 | MAX. | 6,300 |
| LIGHT | — | PARTIAL | 5,200 | PARTIAL | 2,740 |
| FLOODED | 3,240 | FLOODED | 3,240 | EMPTY | — |
| FULL-OFF BOTTOM | 8,000 | ON BOTTOM | — | ON BOTTOM | 0 |
| | 30,240 | | 27,040 | | 27,040 |
| | 30,240 | | 32,340 | | 32,340 |
| | 129-FT | | 140 FT | | 140 FT |
| | | | 5,300 | | 5,300 |
| | | | 3,100 | | 3,100 |

MEANS AND METHODS FOR ANCHORING AN OFFSHORE TENSION LEG PLATFORM

BACKGROUND OF INVENTION

In general, offshore well operations have been conducted from floating vessels, semi-submersible vessels, and platforms having rigid structural legs resting on the sea floor. Each of the above types of offshore apparatus provides certain advantages and disadvantages depending upon the location of the well operation. The quantum and order of disadvantages of such apparatus tend to increase as the water depth at a selected location becomes greater. The disadvantages include both operational or functional disadvantages as well as economic or more costly disadvantages. For example, a rigid fixed leg platform may be practical and feasible in shallow waters of up to about 300 to 400 feet. Such a platform is impractical and difficult to build and install in deep waters in the order of 600 to 2,000 feet. Floating vessels including semi-submersibles are subject to movement from wind and wave forces which impose three dimensional forces on the vessel in relation to a fixed stationary subsea installation. Maintenance of a vessel's position relative to such a fixed subsea installation and the adaptability or accommodation of well equipment to small changes of vessel position is very difficult and presents numerous problems. Changes in movement of a vessel with respect to a riser connection is one example.

To avoid many of the disadvantages of such prior proposed offshore well apparatus, platforms identified as tension leg platforms have been proposed because the installation of such a platform provides many advantages in deep water well operations. Tension leg platforms utilize cables extending from an anchor at the sea bottom to the platform, the buoyant support means of the platform being controlled so that a tension force is imparted to the cables which will prevent the cables from becoming slack under all conditions of loading and operation of the platform. Such tension leg platforms have been disclosed in U.S. Pat. Nos. 3,154,039, 3,648,638, 3,540,396, and 3,780,685. Seadromes of somewhat similar structure are shown in U.S. Pat. Nos. 2,399,656 and 2,399,611. In a preferred tension leg platform shown in U.S. Pat. No. 3,780,685 the buoyant supporting means includes horizontally disposed buoyant members and vertically disposed buoyant members in which the displacement ratio between the horizontal buoyant members and the total displacement of the platform apparatus is between about 0.30 and 0.60 whereby under certain expected wave and weather conditions, vertical force components acting upon the platform apparatus are substantially neutralized and cancelled. A substantially stable tension leg platform apparatus is thereby afforded.

SUMMARY OF THE INVENTION

Therefore, the present invention relates to a tension leg platform apparatus embodying the structure generally described above in which a novel method and means are provided for anchoring such an apparatus and for imparting and maintaining a desired tension in the anchoring cables.

An object of the present invention is to provide a tension leg platform apparatus constructed for effective mobility to bring the platform apparatus to a selected site and for rapidly and easily anchoring the platform apparatus at such a site.

Another object of the invention is to provide a tension leg platform apparatus in which vertical buoyant support members are especially constructed and designed to facilitate anchoring of the apparatus Another object of the present invention is to provide a tension leg platform apparatus wherein vertical buoyant support members of the apparatus are adapted to carry in close association therewith anchor members or shells which are virtually empty to facilitate transport to a location and for initial installation on the ocean bottom.

A further object of the present invention is to disclose and provide a vertical buoyant support member constructed and arranged to permit lowering of an empty anchor shell by means of drill pipe, to then employ the drill pipe to drill a hole in the ocean floor beneath the anchor shell to pin the anchor shell to the ocean floor, and to then employ the drill pipe for transport of ballast material to the anchor shell to provide a selected anchor deadweight to permit desired tensioning of the tension cables connecting the anchor member with the platform apparatus.

A still further object of the present invention is to provide a buoyant support for a tension leg platform apparatus in which means are provided for convenient rapid transfer of ballast material from the platform apparatus to a virtually empty anchor shell or member at the sea bottom.

A still further object of the present invention is to provide a tension leg platform apparatus utilizing virtually empty anchor members for setting said anchor members on the floor bottom.

A still further object of the invention is to provide a novel method of installing deadweight anchors for a tension leg platform and to recover said anchors when the platform apparatus is moved to another location.

The invention contemplates such a novel method of installing deadweight anchors and for positioning a tension leg apparatus at a selected location whereby the tension leg apparatus is maintained in a stable seaworthy condition during such installation.

Various other objects and advantages of the present invention will be readily apparent from the following description of the drawings in which exemplary embodiments of the invention are shown.

DESCRIPTION OF THE DRAWINGS

FIG. 1 is a perspective elevational view of a tension leg platform apparatus embodying this invention and illustrating the apparatus anchored at a location in the ocean.

FIG. 3 is a transverse sectional view taken in the plane indicated by line III—III of FIG. 2*a*.

FIG. 4 is a transverse sectional view taken in the plane indicated by line IV—IV of FIG. 2*a*.

FIG. 5 is an enlarged fragmentary vertical sectional view of the area designated by the phantom circle V of FIG. 2*b*.

FIG. 6 is an enlarged fragmentary sectional view of the area indicated by the phantom circle VI of FIG. 2*b*.

FIG. 7 is a fragmentary transverse sectional view taken in the plane indicated by line VII—VII of FIG. 6.

FIG. 8 is an enlarged top plan view of an anchor member taken in the plane indicated by line VIII—VIII of FIG. 1.

FIG. 9 is an enlarged vertical sectional view of the anchor member shown in FIG. 8, the section being taken in the plane indicated by line IX—IX of FIG. 8.

FIGS. 10*a*, 10*b*, 10*c*, 10*d* and 10*e* show successive steps in installation of the anchor means of this invention each step being correlated to the load and ballast conditions as indicated in the chart below said FIGS. 10*a* – 10*e* inclusive.

FIGS. 11*a*, 11*b*, 11*c*, 11*d*, 11*e* are schematic elevational views of a tension leg apparatus embodying this invention and illustrating the steps of an alternate method of installation, the several steps being correlated with load and ballast conditions as indicated by the charts therebelow.

FIG. 12 is a fragmentary elevational view, partly in section, schematically showing anchor hoisting and lowering means at a vertical column.

In FIG. 1 is generally illustrated a tension leg platform of the type which may include the structure and displacement characteristics of Horton U.S. Pat. No. 3,780,685 which is owned by an assignee common to this application and the patent. The tension leg platform apparatus 20 generally comprises a platform 21 having a deck 22 upon which may be supported necessary wall equipment such as a derrick 23, booms 24 and various other types of well equipment and housing facilities (not shown) for personnel. Platform 21 is supported a selected distance above the surface 25 of the ocean by buoyant supporting means including vertical support buoyant columns 26 and horizontal buoyant support columns 27. The horizontal support members 27 may be interconnected by horizontal buoyant members 28 arranged internally of the triangular arrangement of the horizontal members 27. Such internal arrangement of horizontal buoyant members 28 may also correspond with the internal triangular arrangement shown in Horton U.S. Pat. No. 3,577,946. Horizontal buoyant members 27 may also be interconnected with platform 21 by upwardly extending diagonal and vertical buoyant members 29 and 30 respectively. It will be understood of course, that in the event the platform apparatus 20 is constructed in accordance with the teaching of Horton U.S. Pat. No. 3,780,685, that the horizontal component of the buoyant forces acting on the upstanding diagonal members 29 will form a part of the displacement ratio of the horizontal buoyant members to the total buoyancy of the platform apparatus. In this example of the invention, the buoyant horizontal support members 27, 28 and the diagonal buoyant members 29 may be of any suitable construction, and the converging of the members 28, 29 and 30 toward and at the central portion of the side horizontal buoyant member 27 may be for structural convenience.

Figure 2A:
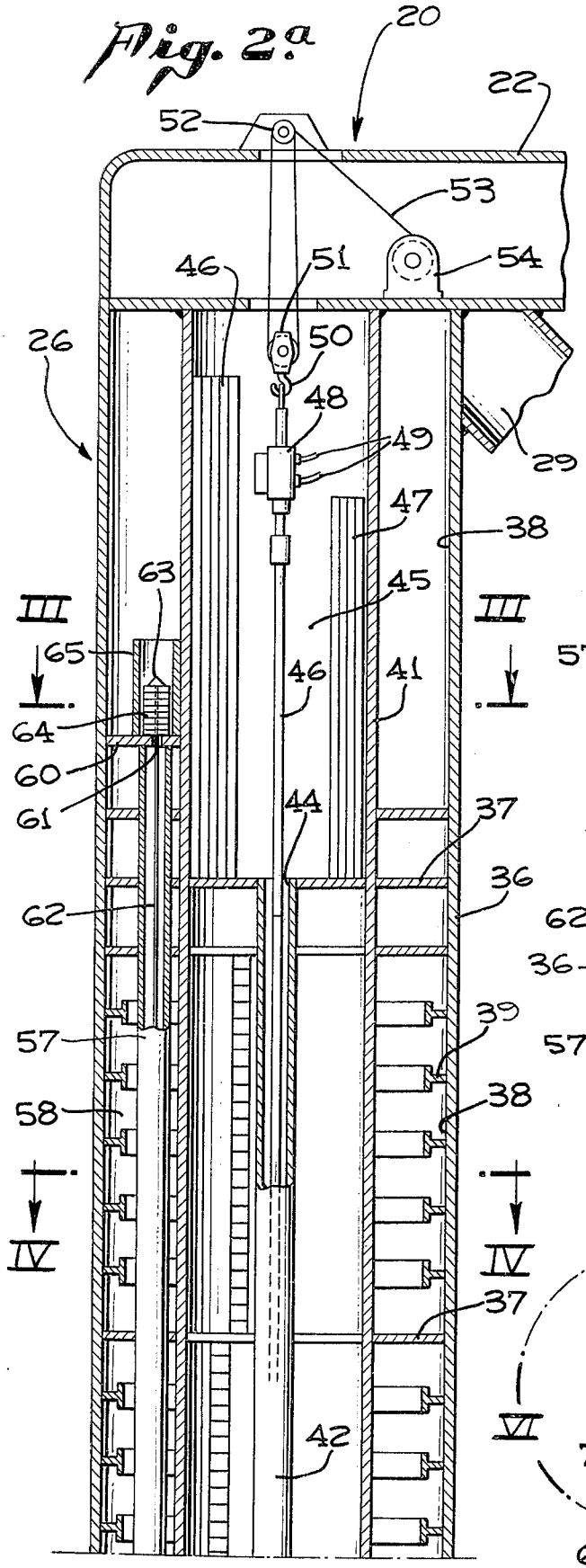
FIGS. 2*a* and 2*b* are vertical sectional views taken in the plane indicated by line II—II of FIG. 1 the sections being enlarged to show the structure of the vertical buoyant support column member.

The platform apparatus 20 also generally includes a plurality of anchor line means 32 extending from the vertical buoyant support members 26 to anchor members 33 adapted to be transported and carried at the bottom end of vertical buoyant members 26 and lowered and adapted to be seated and pinned by pile members 34 on and in the ocean floor. The anchor line means 32 may be generally vertical or may be provided with relatively small outward scope in which the pattern of the anchors 33 corresponds in slightly enlarged configuration to the configuration of platform 20.

Each vertical buoyant support member 26 is of a construction and arrangement shown in FIGS. 2 – 7 inclusive. Each vertical member 26 is of the same construction and only one will be described. Vertical member 26 comprises a cylindrical vertical wall 36 of selected diameter and height such as 28 foot diameter and 200 feet in height. At selected vertically spaced intervals the vertical member is provided with horizontal bulk heads 37 dividing the vertical member into vertical compartments 38. Walls 36 are provided suitable structural reinforcement in well known manner by circular T section structural shapes 39 welded to the internal surface of wall 36.

Figure 2B:
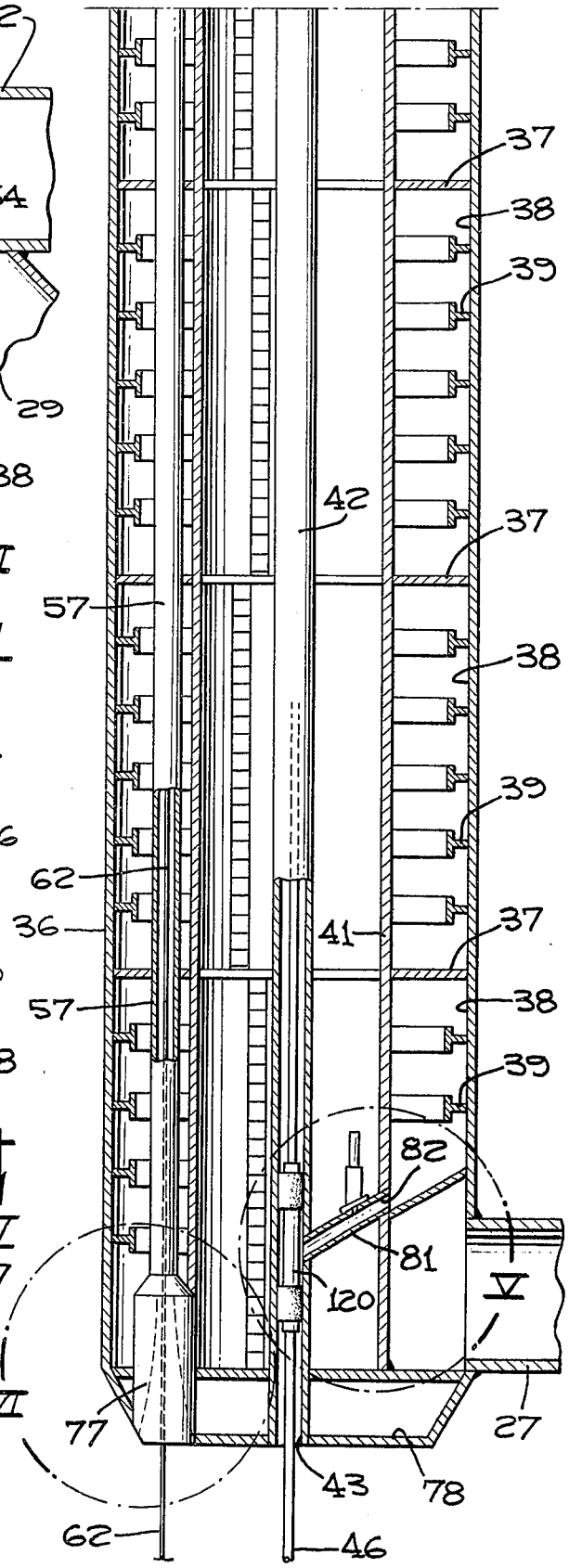

Concentrically arranged within cylindrical wall 36 is a vertically extending inner cylindrical wall 41 which extends for virtually the entire length of vertical member 26. Inner cylindrical wall 41 defines the inner wall of chambers 38 and establishes an annular shape for each chamber 38. Within inner cylindrical wall 41 and commencing at approximately the bottom of the upper annular chamber 38 is a coaxial casing 42 of substantially less diameter and which is provided with a bottom opening 43 at the bottom of member 26 and an upper opening 44 at the lower portion of the uppermost chamber 45 defined by a bulk head 37 which extends entirely across the inner cylinder member 41. Upper chamber 45 provides an elongated storage or supply chamber for vertically racked drill pipe 46 and 47 which may be of different length and diameter. As illustrated in FIGS. 2*a* and 2*b*, lengths of drill pipe 46 may be connected together and may extend downwardly through casing 42 and below the bottom opening 43 of the casing for purposes later described. The upper pipe length 46 may be connected to a suitable power swivel 48 which may be hydraulically driven through fluid conducting tubes 49. Power swivel 48 is carried from a hook 50 on a traveling block 51 connected to a suitable top sheave means 52 from which the block sheave line 53 is connected to a suitable power driven winch 54. It will thus be apparent that drill pipe 46 and 47 may be connected or disconnected in well known manner and lowered or raised in casing 42 by the power swivel and traveling block described above.

Each vertical column 26 is provided with three equiangularly spaced vertically extending guide casings or pipe 57 which provide a through opening from approximately upper chamber 38 to the bottom of vertical member 26. Each guide pipe 57 passes through the horizontal bulk heads 37 and may be held in desired radially spaced relation to the inner cylindrical wall 41 and outer wall 36 by longitudinally and radially extending walls 58, (FIG. 4). Diametrically opposite each wall 58 attached to guide pipe 57 may be a vertically and radially extending reinforcing wall 59. Such longitudinally or vertically extending radial walls 58 and 59 may extend in chambers 38 for a selected length of vertical member 26 or may be provided at spaced intervals depending upon the structural strength requirements of the vertical buoyant member 26. At the top of each guide pipe 57 is a horizontal wall 60 which extends between the outer and inner walls 38 and 41 and which is provided with a port 61 through which an anchor cable 62 passes. The upper end of cable 62 may be provided with a cable head or stop element 63 adapted to seat upon one or more vertically stacked spacer discs 64 assembled within open ended cylinder 65. Spacer discs 64 are selected in number to maintain a measured predetermined tension in anchor cable 62 as later described.

At the bottom end of guide pipe 57, FIG. 6, a cable guide shoe 70 is fitted in the bottom open end of guide pipe 57 and secured therein by suitable means. Guide shoe 70 has a through passageway 71 having a top outwardly flaring and enlarged opening 72, a narrow intermediate throat portion 73 of generally uniform diameter greater than the cable diameter and relatively short length, and a longitudinally extended downwardly and outwardly flaring passage 74 of predetermined radius. The outwardly flaring configuration of passageway portion 74 merges smoothly at 75 with a continuation of said outwardly and downwardly flaring passageway 74 to provide a wide open portion 76 provided in a relatively thick section guide or hawse member 77. Hawse member 77 includes a recessed annular seating 79 for the bottom end of tube 57. Hawse member 77 may be secured as by welding to inner wall 41, to spaced bottom walls 78, and to inclined portions 36*a* of vertical member 26. The curvature of outwardly flaring portion 76 in member 77 is of somewhat less radius than the radius of portion 74 to limit the bending stress imposed on the cable. For example, the radius of portion 74 may be 150 feet and the radius of portion 76 may be 100 feet. The downwardly outwardly flaring bell shape of the cable passageway in guide shoe 70 and hawse member 77 permits limiting of the cable bending stress while reducing the overall size of the bell configuration of the guide shoe and hawse members.

The horizontal bulk heads or floors 37 which divide the vertical buoyant member 26 into compartments or chambers 38 permit such compartments to be used for various purposes such as for the storage of suitable ballast material as well as other types of material. As exemplarily shown in FIG. 5 the bottom-most compartment 38 may contain a suitable ballast material 80 which may be formed of particulate flowable high density material such as taconite or granular hematite. As shown in FIG. 5, such ballast material 80 may be directed by a suitably inclined passageway means 81 provided with a gated opening 82 and an outlet 83 for transfer and transport of ballast material to the interior of drill pipe 46 as later described.

Other compartments 38 and the axial chamber provided by the inner wall 41 may be suitably fitted and equipped with valves and gated inlets and outlets to permit use thereof for ballast purposes or other storage or operational purposes depending upon the use of the platform.

Figure 10A:
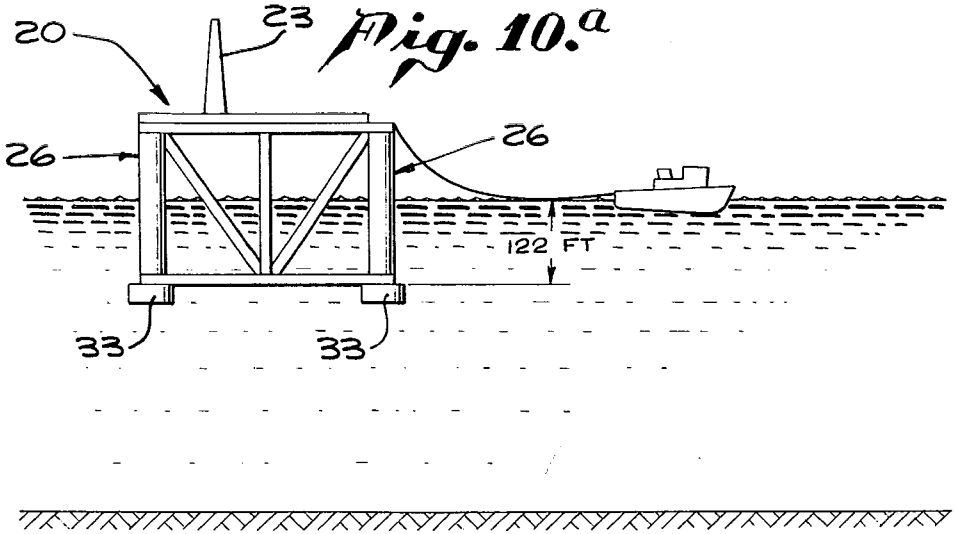

Each anchor member or shell 33 is adapted to be normally transported with the apparatus 20 at the bottom of a column 26 as shown in FIG. 10*a*. Each anchor member 33 includes a cylindrical wall 85 (FIGS. 8 and 9), a bottom wall 86, and an open top 87. Wall 85 is reinforced by vertically extending longitudinal ribs 88 which may be connected to a plurality of angularly spaced diametrically arranged beams 89 of suitable structural section. Beams 89 intersect at the axis of the cylindrical wall 85 and at said intersection is provided a conductor pipe 91 which extends through the bottom wall 86 of the anchor member. Conductor pipe 91 includes a top thick-sectioned portion 92 having an upwardly and outwardly flaring opening 93, the thick section providing sufficient metal for welding of the inner ends of beams 89 to the conductor pipe. The lower end of conductor pipe 91 is also provided with a bottom thick sectioned end portion 94 to provide sufficient metal section for welding of bottom wall 86 thereto. Centrally between the axis of anchor member 33 and its cylindrical wall 85 a radial leg 96 of each beam 89 is provided with cable connector means 98. Each connector means 98 includes a vertical load member 99 secured at its bottom end to bottom wall 86 by gussets 100 welded thereto and at its upper end by gussets 101 secured as by welding to beam 89 and member 99. Extending upwardly from the bottom flange of the beam 89 are unstanding parallel clevis members 102 secured as by welding to beam 89. Clevis members 102 provide pivotal support for a pivot pin 103. Between clevis members 102 a link member 104 is welded to pin 103 and is provided with a pivotal connection at 105 to clevis arms 106 formed integrally with a cable termination, sleeve member 107. The clevis type connector means 98 provides a universal joint for each cable which allows pivotal movement in two directions. The construction and size of the clevis connector means 98 may be in accordance with conventional bridge strand socket design practice. In such practice, excessive wear at the pivotal joints is reduced by using wear resistant metal such as sleeves or inserts made of Hadfield manganese steel at the contact surfaces. It is understood that such pivotal connections for the connector means 98 may also include suitable sealed and lubricated bearing means.

Each anchor member 33 also includes a predetermined thickness and weight of concrete 110 covering and sealing the interior surfaces of the bottom wall 86. The concrete floor 110 may be provided with a cove 111 extending upwardly for a short distance along the cylindrical wall 85. The weight of the concrete 110 is determined in accordance with the required initial ballast to lower the anchor members 33 to the ocean floor at the selected site for the apparatus 20.

The top end 92 of the conductor pipe 91 may be provided with a J slot 114 to provide a releasable connection to a drill pipe having a pin 115 when the anchor member is lowered to the sea bed. To facilitate handling of anchor member 33 a plurality of upwardly extending ported cleats 116 may be provided at opposite ends of each beam 89.

The releasable J slot and pin connection between the top end of the conductor pipe 91 and drill pipe 46 permits lowering of the anchor shell by the drill pipe as later described and also permits the drill pipe to be used for drilling a hole of selected depth in the sea bed to provide installation of a pile member to pin the anchor member to the sea floor or to permit other types of down hole operations such as cementing the pile member in the sea floor.

Drill pipe 46 is also used to introduce or remove ballast from the anchor member 33. After the anchor member 33 has been set in selected location on the sea floor, drill pipe 46 is withdrawn until its bottom end clears the top of the anchor member 33. A closure member or plug may be placed in the top end of conductor pipe 91 and ballast material carried by the vertical column 26 may then be introduced into the drill pipe and into the anchor member. The means for introducing ballast material into the drill pipe is best shown in FIG. 5.

In FIG. 5 ballast material 80 is illustrated as flowing from a ballast compartment 38 along an inclined passageway means 81 to the openings 83 in the quide tube 42. Drill pipe 46 is provided with a ballast packer means 120 which may comprise a sub member 121 having a threaded connection 122 at its top end to an upper section of drill pipe 46 and having a bottom threaded connection 123 to a bottom section of drill pipe 46. Sub member 121 includes a central portion 124 having an enlarged diameter to provide top and bottom annular seats 125 and 126 for annular top and bottom packer members 127 and 128 secured against relative axial movement by top and bottom collars 129 and 130 having threaded connection at 131 and 132 to sub member 121. Packer members 127 and 128 are expandable and include packer chambers 133 and 134 in fluid communication with each other by passageways 135 at the top of packer member 127 and a longitudinally extending passageway 136 to the bottom packer chamber 134.

Between top and bottom packer members 127 and 128 sub member 121 is provided with a transverse opening 140 for communication with the interior of guide tube 42. When the packing means 120 is longitudinally positioned with the opening 140 opposite the guide tube outlet 83 it will be apparent from FIG. 5 that ballast material flowing through passageway 81 will enter the guide tube 42 and the opening 140 for flow downwardly through the drill pipe 46. The packer members 127, 128 prevent flow of ballast material between the guide tube 42 and the drill pipe 46.

To facilitate flow of the ballast material 80 into and through the drill pipe 46, packer sub 121 includes a nozzle member 141 which extends into the opening 140 and which has a discharge opening 142 located above the inclined axis of the passageway means 81. Fluid such as sea water introduced into the top end of drill pipe 46 by means of a pump will provide a liquid vehicle for flow of ballast material through the bottom sections of the drill pipe 46 to the anchor member 33. In addition, such fluid through passageways 135 and 136 will serve to pressurize the packer chambers 133 and 134 to provide a seal between the packer members and the internal surfaces of the guide tube 42. Such fluid will also pass through downwardly inclined passageways 144 into the annular space between the sub member 121 and the guide tube 42 and serve to flush the annular space surrounding the central portion of the sub member between the packer members.

When the flowable ballast material emerges from the bottom end of drill pipe 46 above the top opening 87 of the anchor member 33, the ballast material will flow into the anchor shell and fill the anchor shell with a selected amount and weight of ballast material so that the anchor can function as a deadweight anchor.

The drill pipe 46 may also be used in somewhat similar manner to introduce a pressure fluid such as sea water into the top opening of a filled anchor shell in order to flush and remove from said shell the previously deposited ballast material to that the anchor member 33 may be lifted and raised to transport position at the bottom end of vertical column 26.

The tension cables 62 may be of a structural bridge wire rope type including wire rope of selected tension and strength characteristics. For example, ultimate strength of each cable may be 5,000 Kips, a diameter excluding jacket of about 7 inches, a modulus of elasticity of $21 \times 10^6$ psi, a shipping bending diameter of 16 feet. To protect such a cable from corrosion caused by the sea water, the cable may be encased in an unbroken sealed polyethylene jacket of approximately ½ inch thick. The cables 62 are designed to be under tension load at all times because the selected buoyancy of the platform and its loads must always exert a tension force on the cables under all conditions of operation. The tension cables 62 are subjected to the static load resulting from the excess buoyancy of the platform and its loading and also are subject to variable loads resulting from wind and current and the superimposed cyclic load caused by wave induced motion. Such cyclic loads are reduced to a minimum when the platform is designed and installed in accordance with the teaching of U.S. Pat. No. 3,780,685.

In installation and operation of the apparatus 20 described above and with particular reference to FIGS. 10*a*, *b*, *c*, and *d*, and FIG. 12, anchor members 33 are attachable to the cables 62 near the shipyard where the tension leg platform is being constructed. A convenient way of attaching the anchor members 33 is to first lower and set anchor members on the sea floor in approximately 160 feet of water with the anchor members arranged in a pattern which corresponds generally to the arrangement of the apparatus vertical columns 26. The apparatus is floated over the anchors and the tension cables are lowered and attached to the anchor members by divers. The anchor cables 62 are initially attached to power operated winches located on the platform deck, a winch being provided for each of the three cables at each vertical column 26. The cables are passed down through the guide tube 57 and through the hawse member 76. The winch storage drums for the cable are equipped with brakes sufficient to control the running out of the cables during the lowering procedure.

After the bottom ends of the cable are connected as previously described to the anchor member, the drill pipe is lowered and connected by the J slot and pin connection to the anchor member. The anchor member is then raised by means of the drill pipe until the anchor member reaches the bottom of the column 26, the cables being rewound on the winches.

Other equipment such as the pile sections, drill pipe, anchor ballast material may then be loaded on the platform in the space provided therefor. The apparatus 20 is then ready to be towed to its location at sea.

In transport condition as shown in FIG. 10*a*, the apparatus may be towed at a depth of 122 feet. Load and ballast conditions during this stage of installation are indicated in the chart below the respective figure, FIG. 10*a*, in which an exemplary test platform is provided with a weight of hull and machinery of 18,000 Kips, anchor ballast tanks are dry and their weight is about 9,500 Kips, the anchor members are empty and their weight is approximately 900 Kips and variable loading on the platform is estimated at approximately 600 Kips. A total weight and displacement of 29,000 Kips is thus provided and a draft of 122 feet is indicated.

Figure 10B:
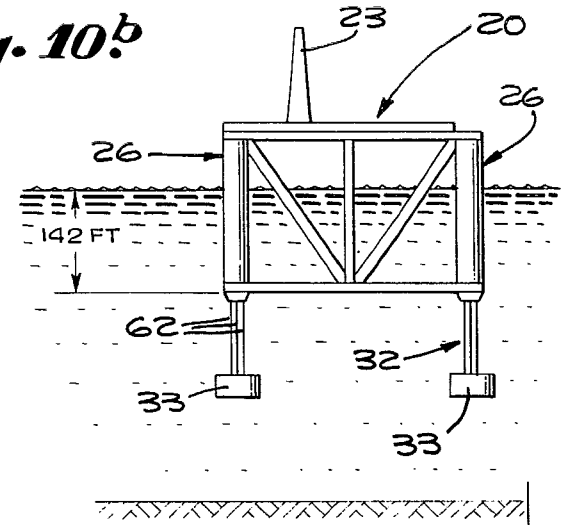

Apparatus 20 is held over the platform site during further installation by tugs. Ballast tanks in the vertical columns 26 are partially flooded and the anchor ballast tanks are full flooded to lower the platform apparatus to a selected depth, in this example 142 feet, or normal operating draft of 140 feet plus an additional 2 feet. The weight in Kips of ballast and total weight is shown in FIG. 10*b*. Anchor members 33 are then lowered by means of drill pipe 46 and as they are lowered the anchor tension cables 62 are permitted to be paid out from the storage winch drums.

The length of the tension cables are set for a draft of 140 feet. The cable ends may be stopped at the upper end of guide tubes or hawse pipe 57 at such preselected final cable length which allows approximately 2 feet of cable slack when anchor members 33 touch the sea floor. Upon further lowering of anchor members 33, the weight of the empty anchor members is transferred from the anchor members to the sea floor. Because of the additional relative buoyancy produced by the resting of the anchor members on the sea floor, the apparatus is permitted to rise in the ocean until slack is taken out of the cables and the cables are extended to their full preselected length of 140 feet. Such condition is indicated in FIG. 10*c* and the chart therebelow where it will be apparent that the total weight of the apparatus has been reduced by the weight of the anchor members and the total weight is now 31,800 Kips; the displacement being indicated at 32,340 Kips. The difference between the prior weight of 32,700 is represented by the anchor force on the sea floor of 360 Kips and cable tension is indicated at 540 Kips. The draft of the apparatus is 140 feet.

In this method of setting the operating draft and cable length, each cable length may be the same or different length depending upon the horizontal or irregular condition of the sea bed upon which the anchor members rest. Any irregularity in the sea floor can be readily compensated for by making one anchor line longer than the others. Empty anchor members also facilitate slight changes in position or location of the members on the sea floor. Also the entire platform may be easily relocated by raising the anchor members prior to transferring the ballast material.

When all three anchor members 33 are located on the sea floor and the apparatus is in the condition indicated as shown in FIG. 10*c*, ballasting of the anchor members is commenced. Ballast material 80 carried in the storage compartments 38 in the vertical columns 26 is transferred to the drill pipe 46 at the opening 83 as defined by the ballast packer means 120 previously described. The ballast material is flushed down the drill pipe to the anchor member until the anchor member is filled with a selected amount of ballast. Transfer of ballast from the vertical columns to the anchor member increases the anchor deadweight to 3,100 Kips. Since ballast has been transferred to the anchor members 33 which rest upon the sea bottom, the ballast in the vertical columns must be increased at the same time. Such increase in ballast tanks in the vertical columns 26 may amount to 5,340 Kips. Thus as shown in FIG. 10*d* and the chart thereunder, the total weight of the apparatus is indicated at 27,040 Kips, the total displacement is the same as in FIG. 10*c*, namely 32,340 Kips and the cable tension forces have increased to 5,300 Kips.

After the ballast has been transferred to the anchor members 33 which now serve as deadweight anchors, a pile member 34 may be installed by conventional drilling and cementing operations. Drill pipe 46 which served to lower the anchor members and to transfer ballast thereto, may be inserted into and extend through the conductor pipe 91 in the anchor member 33. Power swivel 48 provides the necessary rotary power source to turn the drill pipe to drill the hole underneath the anchor member.

The pile member 34 may be installed by several well known methods depending upon the condition of the sea bed. If the sea bed is relatively soft, a drill bit may be attached to the end of the pile member and the entire unit drilled in and cemented in one operation, the drill bit being expendable. If the sea bed is hard, a pilot hole may be first drilled by the drill pipe and a suitable drill bit after which the pile member would be landed and cemented in well known manner.

In alignment of the drill pipe with the conductor pipe 91, and installation of the pile member under both procedures, the tensioned anchor cables or lines may be used as a line guidance means for entering the conductor pipe and hole. The design length of a pile member depends upon the soil conditions at the site and may be between 150 to 250 feet.

After the deadweight anchor members 33 have been ballasted and the pile member 34 installed, tension in the cables is adjusted. Cable tension is adjusted by modifying the amount of ballast in the vertical column ballast tanks and the anchor ballast tanks. It will be apparent that if all of the anchor ballast material in chambers 38 is used to fill the anchor members 33 on the sea floor, apparatus 20 will have been fully relieved thereof and the entire weight thereof transferred to the deadweight anchor member. The ballast tanks in vertical column 26 may be flooded with ballast water until a desired weight of ballast is provided taking into account variations in loads on the platform and other factors in order to tension legs 32 to a selected stress.

In FIGS. 10*e* of this example, variable loads are increased to 6,300 Kips, the partial ballast load decreased to 2,740 Kips while the total weight of the apparatus remains the same, FIG. 10*d*, namely at 27,040 Kips. The tension in cables 62 is unchanged. Under such exemplary conditions, the apparatus could be subject to ocean waves of up to 15 feet before tension cables 62 would become slack or anchor members 33 lifted off the sea floor.

In such a method of installation of the anchors and positioning the tension leg platform at a selected site, it will be noted that the anchor members may be rapidly installed without requiring assistance of other large pieces of equipment such as a barge or a pile driver. The internal arrangement of each vertical buoyant column with drill pipe, anchor line, and ballast facilities provides convenient effective means for placing the platform apparatus in operative condition over a selected work site. It will be understood that operation of separate drill pipe, anchor line, and ballast facilities in the several vertical columns will be coordinated and that the lowering of empty anchor members in the above described method simplifies such coordination. Moreover, during installation the tension leg platform remains seaworthy and stable.

In FIGS. 11*a* – 11*e* there is shown another method of installing the anchors of a tension leg platform described above and positioning it at a selected site over a sea bed. In this modification of the anchoring system, the anchor members 33 are filled with anchor ballast material prior to setting the anchor members on the sea bed.

In detail, FIG. 11*a* indicates conditions of an apparatus 20 having vertical buoyant support members 26 carrying anchor members 33 in identical fashion to that illustrated in FIG. 10*a*.

At the platform site and while the platform is held in position by tug boats, sea water may be flooded into the anchor ballast tanks until they are at full flooded condition. The empty anchor members 33 may then be lowered on drill pipe 46 with the tension cables 62 following the anchor member until cables begin to take the empty weight of the anchor members. In FIG. 11*b* the anchor ballast tanks are indicated as full flooded with a weight of 10,740 Kips, and the anchors 33 are spaced above the sea floor about 11 feet.

Cable length for each of the tension cables 62 is then set to a 140 feet operating draft for the platform apparatus. When the tension cable length has been established, anchor ballast from the anchor ballast tanks is then transferred to the lowered empty anchor members through drill pipe 46. When the anchor ballast is transferred to the anchor members while the apparatus is at the draft of 129 feet and the anchor members are above the sea floor, the ballast conditions of the apparatus 20 remain the same except for the change in location of the anchor ballast material from support members 26 to the new location of the anchor members 33 just above the sea floor.

To set the anchor members on the bottom of the sea floor, and such will occur virtually simultaneously since the three anchor members have been ballasted and are at preselected cable length, the ballast tanks may be partially flooded until the entire apparatus settles to a lower draft of 140 feet and the anchor members rest upon the sea bottom. The anchor cable tension is adjusted by flooding the ballast tanks so that, as illustrated in FIG. 11*d*, the ballast tanks include a weight of 5,200 Kips, the anchor force on the sea floor is 3,100 Kips and the cable tension is about 5,300 Kips. After the anchors are set upon the floor and the cable tension adjusted, the anchor piles may be drilled beneath each anchor member by means of the drill pipe as previously described.

Further adjustments in ballasting and cable tension may be required by modifying the variable loads on the platform deck and by adjusting the anchor cable tension by pumping the ballast tanks. As indicated in FIG. 11*e* the ballast tanks may weigh 2,740 Kips, the variable loads have increased to 6,300 Kips and the remaining factors are the same as in the previous FIG. 11*d*.

One of the advantages of the modified method of anchoring the apparatus is that the amount of flooding of the anchor ballast chambers could be preset so that by merely opening the flood valves, the exact amount of ballast would be taken on thereby insuring correct final anchor cable tension. Thus once the already ballasted anchor members are seated on the sea floor, full anchor cable tensions are quickly achieved on all three tension legs 32. Such rapid lowering of the anchor members and the establishment of anchor cable tension also serves to eliminate a tendency of anchor members from bounding off the sea floor. The modified anchor system may be made of lighter construction since they are not required to act as deadweight anchors while they are ballasted. In the previous embodiment of the anchor system, it will be apparent that since the anchor members are placed upon the sea bottom in unballasted condition, they are readily laterally movable and adapted to be precisely located at a selected anchor site.

In both methods of installation of anchor systems as described above, drill pipe carried in each of the vertical buoyant support members 26 is used to lower anchor members to the sea floor. In the first method of installation, the anchor member may be relatively light weight because the anchor member is lowered in empty condition until it rests upon the sea floor where ballast material fills the anchor member. Thus standard drill pipe may be employed and extra strong drill pipe is not required.

In the second method of installation it should also be noted that the anchor members are lowered in empty condition to a location above the sea floor where the anchor member is additionally supported by the tension cables. Thus in the second method of installation, the drill pipe, to provide a means for transfer of ballast material to the anchor shell, is relieved of its load in supporting the anchor shell by disconnecting the drill pipe at the J slot and the anchor shell is supported by the tension cables during the ballasting operation.

Since the lower end of the drill pipe is located adjacent the anchor member after the anchor member has been lowered, the drill pipe is used to transfer ballast material to the anchor member and to drill any pile setting hole through the conductor pipe in the anchor member as desired. Thus the step of raising the drill pipe and replacing it with some other drilling equipment is not required by the methods of installation of an anchor member as described above.

While both methods of installation described above contemplate drilling of a hole beneath the anchor member for purposes of installing a pile member therein, connected to the anchor member, it will be understood that in some installations and under certain circumstances it may be desirable to prepare the pile member anchoring part prior to the positioning of the tension leg platform apparatus thereover as described above. Such preset separately drilled in pile members may be connected with suitable lines held in vertical orientation by upper float members so that the upper end of the line may be found and connected to a platform apparatus of this invention at the hawse openings at the bottom of each buoyant vertical support member. The pile member is not only useful in preventing lateral movement of an anchor member on the sea floor, but also is characterized with a pull-out force which must be exceeded before the pile member fails to serve as part of the anchoring system. Thus in the above example, the pinning of the deadweight anchors by pile members enhances the anchoring characteristics of the anchor members and the magnitude of force required to lift up a ballasted anchor member.

The method of handling the ballast material from the vertical buoyant support member 26 to the anchor member 33 affords gravitational flow of ballast material whether it is granular material or fluid such as sea water. If the ballast material is of flowable granular form and remains in such form after placement in the anchor member, the anchor member may be recovered if desired by subjecting the flowable ballast material to jet fluid action which would wash the ballast material out of the anchor member to sufficiently lighten the anchor member so that it can be raised by drill pipe.

The use of three tension lines 62 as a mooring line or tension leg line is also advantageous because the several lines may be employed as guide lines to facilitate access to the conductor pipe in the anchor member and may also be individually adjustable to accommodate the anchor member to a sea floor with irregularities.

In each of the above methods of installations, the tension leg platform apparatus is seaworthy and stable during the entire installation operation.

It will also be readily apparent that the ballasting and tensioning of the cables in each of the methods of installation described above may be accomplished under controlled conditions so that the anchor members may be substantially located in accordance with a selected pattern at a well site and that tensioning of the anchor lines to a preselected value may be readily and quickly accomplished.

Various changes and modifications may be made in the apparatus and the exemplary methods of the invention described above, which may come within the spirit of this invention, and all such changes and modifications coming within the scope of the appended claims are embraced thereby.

We claim:

1. In a method of anchoring a floating offshore platform apparatus having tension anchor lines, said anchor lines being generally vertically disposed and the offshore platform apparatus having a buoyant support means including an upstanding buoyant support member, a supply of flowable ballast material on said apparatus, and an anchor means having anchor compartments therein for said ballast material, said anchor means being transportable at the bottom of said buoyant support member;

flooding ballast tanks in said buoyant support means to lower said apparatus to a selected depth;

setting tension lines to a selected depth;

lowering said anchor means with substantially empty anchor compartments by drill pipe;

and transferring said ballast material from the supply of ballast material through said buoyant support member and drill pipe to said anchor compartments.

2. In a method as stated in claim 1 wherein the step of lowering the anchor includes suspending said anchor on the lower end of drill pipe carried by and extending through said buoyant support member.

3. In a method as stated in claim 2 including the steps of drilling with said drill pipe and a hole in the sea floor centrally of the anchor and after the anchor compartments are filled with ballast material.

4. In the method as stated in claim 3 including the step of setting a pile member in said drilled hole, and cementing the pile member therein, said pile member being interconnected with said anchor.

5. In a method as stated in claim 1 wherein said tension lines are set for a selected operating depth;

said anchor means are lowered to the sea floor;

and said ballast material is transferred to said anchor means at the sea floor.

6. In a method as stated in claim 1 including the steps of:

fixing the length of said anchor lines to provide a selected operating depth for said apparatus; and flooding ballast chambers in said support member to lower the apparatus a selected distance below said operating depth.

7. In a method as stated in claim 1 including the step of:

communicating a ballast packer sub in said drill pipe with said supply of ballast material; and moving said ballast material through said drill pipe by introducing fluid into said drill pipe to cause aspiration of ballast material at said packer sub and to cause said ballast material to readily flow through said drill pipe.

8. In a method as stated in claim 1 including the step of:

providing each anchor compartment with an opening;

and introducing a jet stream of fluid into said compartment to flush said ballast material from said compartment to permit lifting of said anchor from the sea floor.

9. In a method as stated in claim 1 wherein the support member comprises a vertical buoyant column having a central through bore for drill pipe; comprising the step of:

carrying said anchor at the bottom of said vertical column, said anchor having a conductor tube in alignment with said drill pipe through bore.

10. In a method as stated in claim 1 wherein said tension lines are set for a selected operating depth;

said anchor means is lowered until said tension lines hold said anchor means suspended above the sea floor;

said ballast material being transferred to said anchor means while suspended above said sea floor;

and flooding said ballast tanks in said buoyant support means until said anchor means are set upon said sea floor.

11. In a method as stated in claim 10 including the step of:

disconnecting the drill pipe from said anchor means while said tension lines hold said anchor means above the sea floor.

12. In a method as stated in claim 10 including the step of:

presetting the flooding of said anchor means and said ballast tanks whereby selected tension in said tension lines is achieved when said anchor means is set on said sea floor with a predetermined weight.

13. Means for anchoring a floatable tension leg platform having buoyant support members comprising in combination:

means including a ballast chamber adapted to carry a supply of ballast material in a buoyant support member;

an anchor means having a ballast compartment;

means detachably carrying said anchor means from said buoyant support member;

a plurality of anchor line means guided in said buoyant support member and connected to said anchor means;

drill pipe means carried by said buoyant support member and adapted to be connected to said anchor means;

said anchor means including a conductor pipe therethrough to communicate with said drill pipe means;

and means for transferring ballast material from said ballast chamber through said drill pipe means to said ballast compartment in said anchor means whereby said anchor means may be transported by said tension leg platform without said ballast material therein, set on a sea floor without said ballast material, and filled with said ballast material to a selected weight after location of the anchor means on the sea floor.

14. In a means as stated in claim 13 wherein said anchor ballast compartment has an opening at its top;

and means for jetting fluid into said anchor ballast compartment to move anchor ballast material through said opening to lighten said anchor means for lifting from the sea floor.

15. In a means as stated in claim 13 including means including said drill pipe for drilling into said sea floor through said conductor pipe;

and a pile member movable through said conductor pipe and into said drilled hole for restraining said anchor means against lateral movement relative to the sea floor.

16. In a means as stated in claim 13 wherein buoyant support member includes a vertically disposed column structure having an axial casing for said drill pipe means and in alignment with said conductor pipe;

and means for connecting said anchor means to said drill pipe.

17. In a means as stated in claim 16 including a ballast packer sub between said casing and said drill pipe means adjacent said ballast chamber for transferring ballast material from said ballast chamber into said drill pipe means and into said anchor ballast compartment.

18. In a means as stated in claim 13 wherein said support member includes a vertically disposed column structure;

an axial conductor tube means extending for substantially the length of said column structure;

a plurality of equally angularly spaced anchor line casings for said tension anchor lines adjacent the periphery of said column structure;

a pipe rack chamber at the top of said column structure;

said ballast chambers being located at the lower portion of said column structure, attachment means for carrying said anchor means at the bottom of said column structure;

and means providing communication between said ballast chamber and said axial conductor tube means.

19. In a means as stated in claim 13 wherein said anchor means includes a bottom wall and a cylindrical side wall upstanding therefrom;

a pipe conductor means coaxial with said cylindrical side wall;

radially extending frame members connecting said pipe conductor and said side walls;

universal means for connecting one end of an anchor line to said anchor means on said frame members;

and solid ballast material at the bottom of said anchor means;

said cylindrical wall providing said anchor ballast compartment and an opening for reception of said ballast material.

20. In a method of anchoring an offshore platform apparatus having generally vertically disposed tension anchor lines and carrying an anchor shell separable from said apparatus and connected to said tension anchor lines, said apparatus having ballast chambers, said anchor shell having a ballast compartment, including the steps of:

connecting a length of drill pipe to said anchor shell, lowering to a selected depth said anchor shell by adding lengths of said drill pipe, said tension anchor lines being connected to and following said anchor shells during such lowering, setting said anchor shell on the sea floor, and transferring ballast material from said ballast chambers through said drill pipe to said anchor shell ballast compartment.

* * * * *